US006874624B2

(12) United States Patent
Redzisz

(10) Patent No.: US 6,874,624 B2
(45) Date of Patent: Apr. 5, 2005

(54) HANGING ORGANIZER AND STORAGE DEVICE

(75) Inventor: Andrezj M. Redzisz, Wheeling, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 15 days.

(21) Appl. No.: 10/365,264

(22) Filed: Feb. 12, 2003

(65) Prior Publication Data

US 2003/0221978 A1 Dec. 4, 2003

Related U.S. Application Data

(60) Provisional application No. 60/356,536, filed on Feb. 13, 2002.

(51) Int. Cl.[7] ..... A45C 7/00; A45C 11/26; A45C 13/36

(52) U.S. Cl. ..... 206/278; 206/279; 206/284; 206/298; 190/126; 190/127; 190/901; 383/23; 383/39

(58) Field of Search ..... 206/278, 279, 206/284, 298, 288; 190/107, 126, 127, 901; 383/22, 23, 39; 248/302

(56) References Cited

U.S. PATENT DOCUMENTS 682,201 A * 9/1901 Kelley ..... 383/39
1,014,499 A * 1/1912 Macdonald ..... 206/298
1,392,716 A * 10/1921 Sjpraggins ..... 248/99
1,521,897 A * 1/1925 Saluda ..... 383/20
1,579,023 A * 3/1926 Myers ..... 223/91
1,682,046 A * 8/1928 Johnson ..... 206/278
1,749,992 A * 3/1930 Willis ..... 383/23
1,909,942 A * 5/1933 Fingerman ..... 206/278
2,298,786 A * 10/1942 Dubofsky et al. ..... 190/126
2,715,428 A * 8/1955 James ..... 383/12
3,139,133 A * 6/1964 Spector ..... 190/111
3,907,118 A * 9/1975 Pelavin ..... 211/113
4,846,430 A * 7/1989 Ke ..... 248/215
4,858,867 A * 8/1989 King ..... 248/214
4,901,899 A * 2/1990 Barrett ..... 224/223
5,002,401 A * 3/1991 Blackman ..... 383/38
5,209,344 A * 5/1993 Smith ..... 206/6.1
5,427,239 A * 6/1995 Hunt ..... 206/372
5,628,398 A * 5/1997 Jackson ..... 206/287.1
5,692,604 A * 12/1997 Houk ..... 206/278
2002/0071618 A1 * 6/2002 Felsenthal
2002/0125150 A1 * 9/2002 Thompson

* cited by examiner

*Primary Examiner*—Sue A. Weaver
(74) *Attorney, Agent, or Firm*—Banner & Witcoff, Ltd.

(57) ABSTRACT

A hanging organizer and storage device includes a semi-rigid pad or pad sections encapsulated in a fabric material with a circumferential wire reinforcement and a hanging hook construction attached to the top edge of the organizer for suspension from a panel or door.

10 Claims, 4 Drawing Sheets

FIG.1
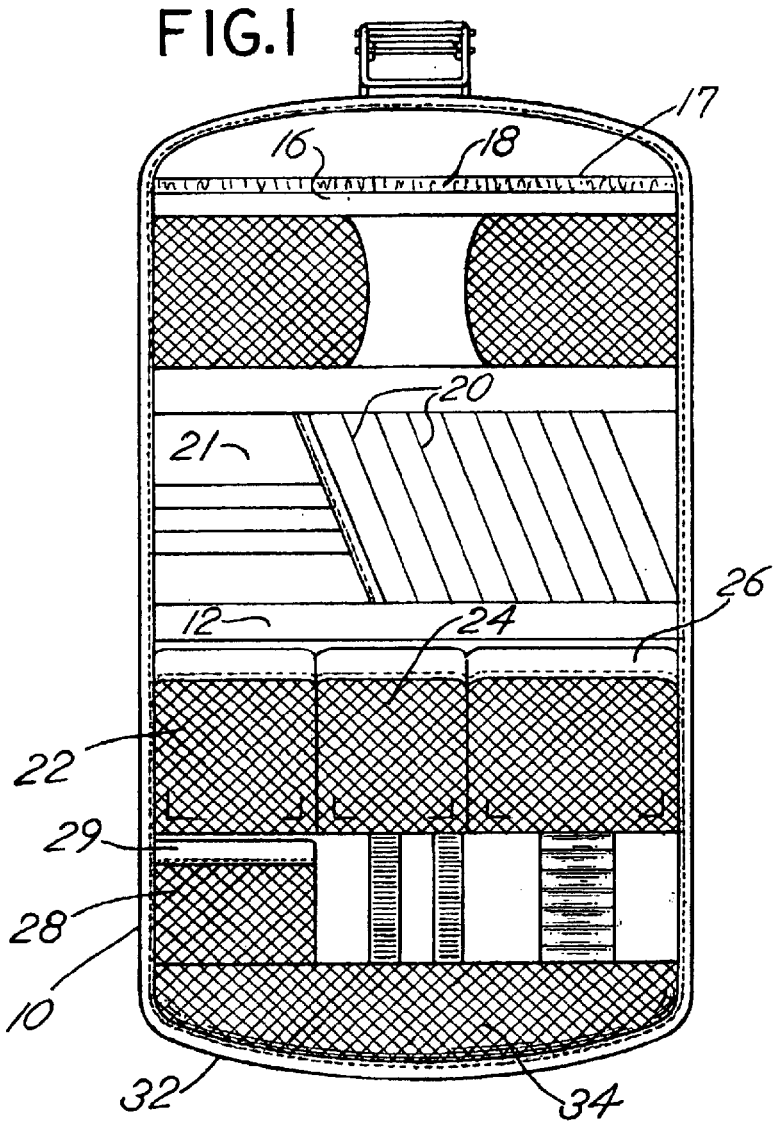
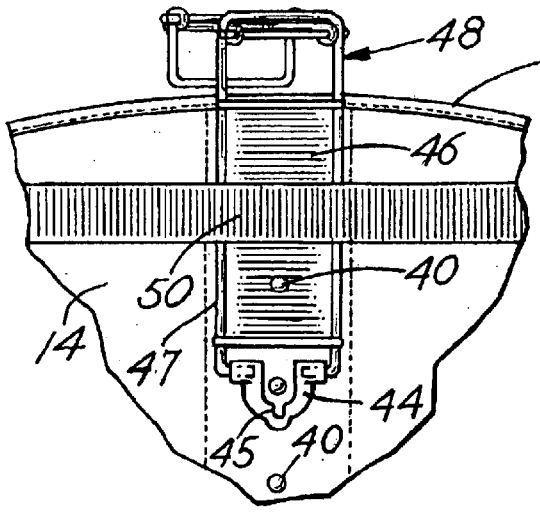
FIG.2

FIG. 5
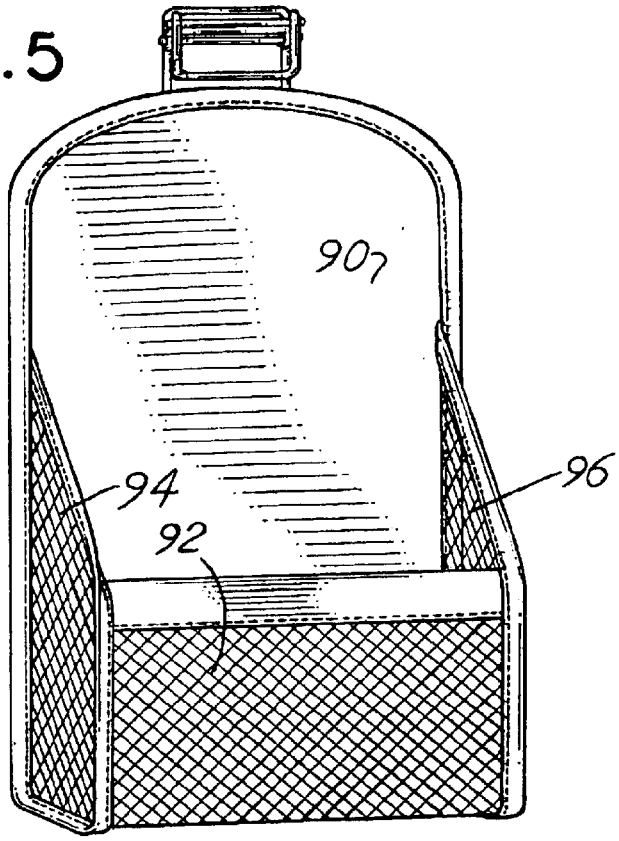
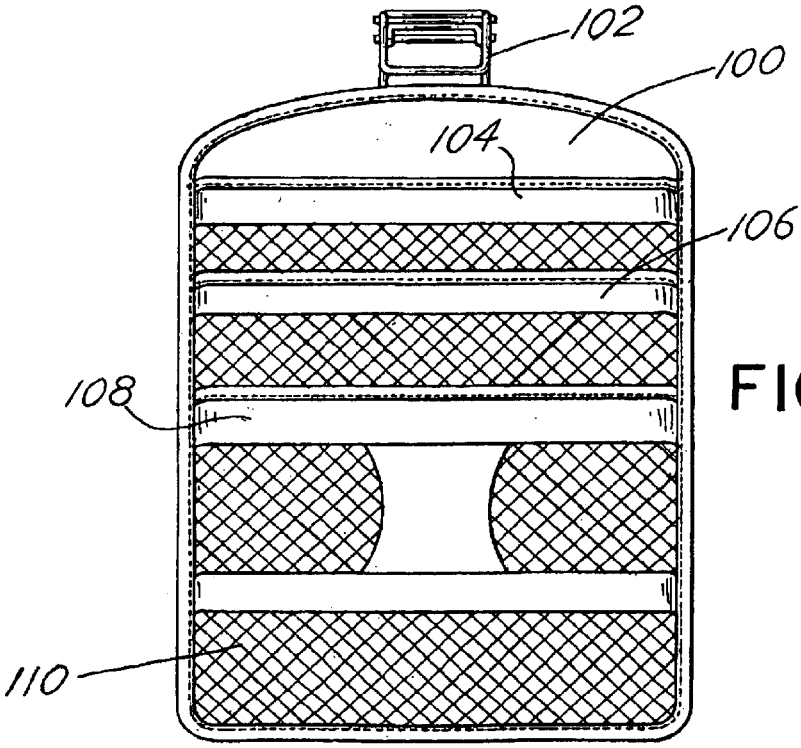
FIG. 6

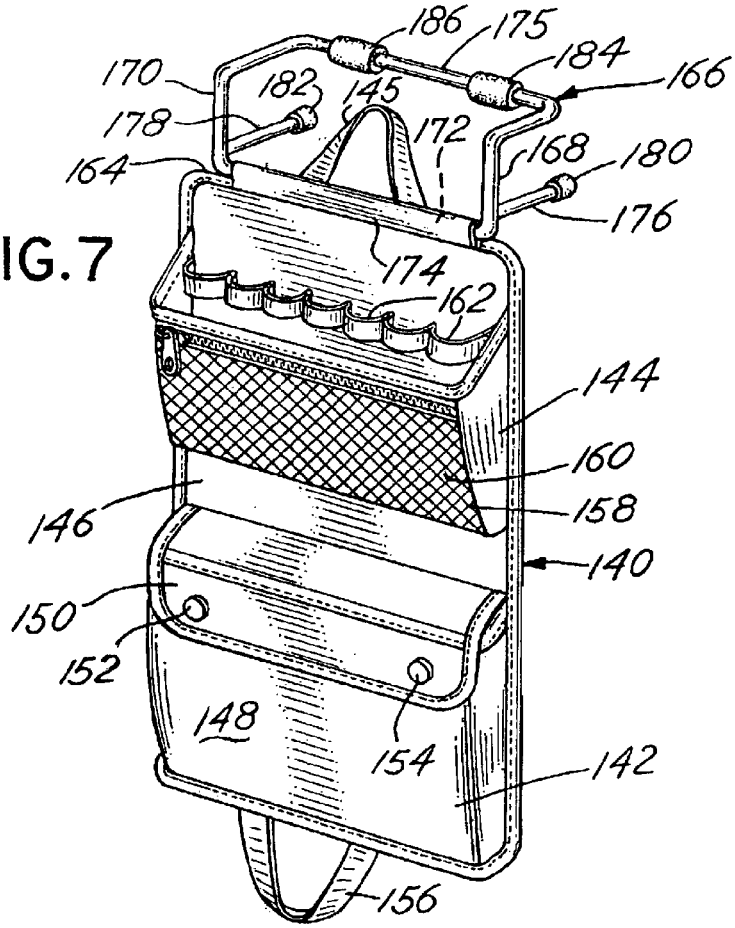
FIG.7
FIG.8
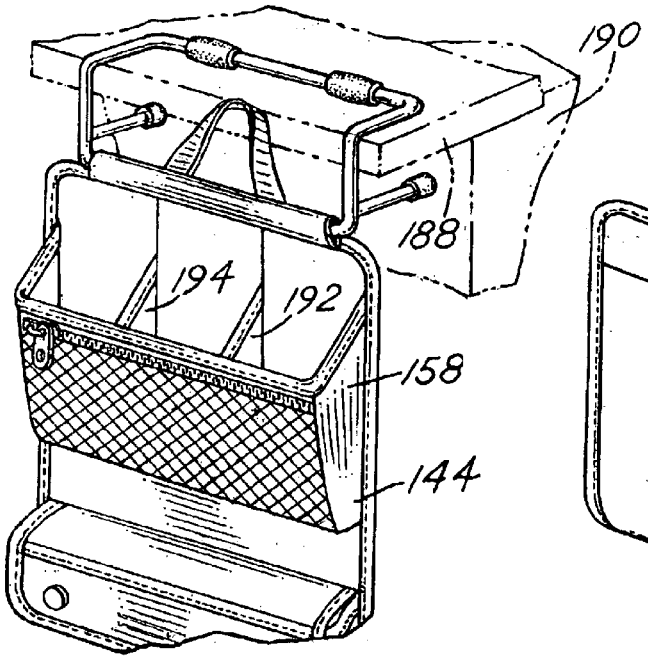
FIG.9
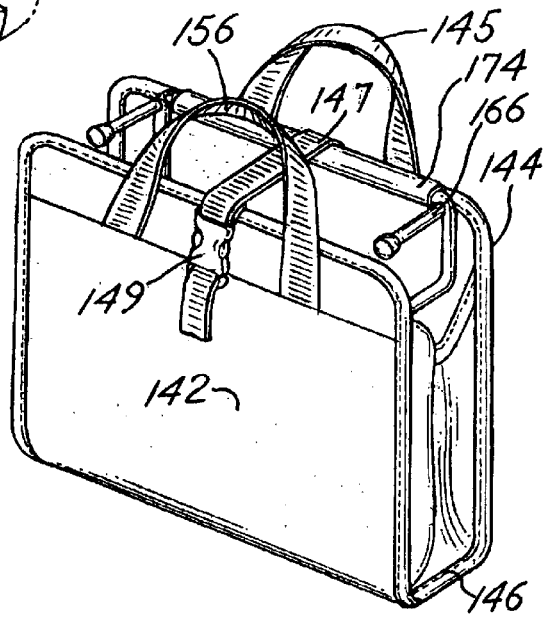

HANGING ORGANIZER AND STORAGE DEVICE

CROSS REFERENCE TO RELATED APPLICATION

This is a utility application based upon a previously filed provisional application, Ser. No. 60/356,536 filed Feb. 13, 2002, entitled "Hanging Organizer and Storage Device" which is incorporated herewith by reference for which priority is claimed.

BACKGROUND OF THE INVENTION

In a principal aspect the present invention relates to a hanging organizer and storage device.

Office cubicles typically include panels or wall sections which are arrayed in a large, open, office space in a manner dividing the large space into smaller sized cubicles. The wall panels forming the cubicles are typically adjustable, often electrified, and may include light strips. A desk is usually enclosed within such a cubicle. A personal computer or computer keyboard and video screen are often positioned on the work desk along with baskets or other containers for files, writing instruments and the like. Nonetheless, such cubicles often do not include adequate or sufficient room for storage of the papers, discs and other items necessary to provide an efficient work space. Thus, there has developed a need for providing additional means for storage of files, papers, writing instruments and the like in such cubicles. Such storage means desirably will be inexpensive, highly portable, have an aesthetic appearance and be easily accessed by the user of office equipment stationed at such a cubicle station.

SUMMARY OF THE INVENTION

The hanging organizer and storage device of the invention is designed to be used in offices, workrooms, work cubicles, and the like. In a preferred embodiment, the device comprises a generally semi-rigid, planar pad fabricated from a plastic board in combination with a circumferential wire rod and binding of fabric that encapsulates the wire rod and plastic board. The back side of the organizer includes a mounting system for engagement with an adjustable hanging bracket for hanging the organizer on a door or wall. The front side of the organizer includes pockets arrayed to hold various items such as business supplies, folios, decorative items, tools and other office supply or decorative items. The device is configured to hang flat against a wall surface. Alternative embodiments of the invention include a hanging wall unit for holding plants or the like, a hanging wall unit which can be utilized as a file organizer, and units which may be hung on the edge of a horizontal table top or desk top.

Thus, it is an object of the invention to provide an improved construction for a device which can be hung on doors, wall panels, tables and the like to provide a means for holding and organizing items such as folders, files, utensils and the like.

It is a further object of the invention to provide a hanging organizer which can be folded compactly and which can be hung at adjustable heights on a door, for example.

Yet a further object of the invention is to provide an improved hanging organizer having a variety of embodiments useful for special purposes.

These and other objects, advantages and features of the invention will be set forth in the detailed description which follows.

BRIEF DESCRIPTION OF THE DRAWING

In the detailed description which follows reference will be made to the drawing comprised of the following figures:

FIG. 1 is a front elevation of a first embodiment of the hanging organizer of the invention;

FIG. 2 is a partial elevation of the back side of the organizer of FIG. 1;

FIG. 5 is an isometric view of an alternative embodiment of the hanging organizer of the invention;

FIG. 6 is a front elevation of a second alternative embodiment of the hanging organizer of the invention.

FIG. 7 is an isometric view of a third alternative embodiment of the hanging organizer of the invention;

FIG. 8 is an isometric view illustrating a further configuration for the alternative embodiment of FIG. 7; and FIG. 9 is an isometric view of the embodiments of FIG. 7 or 8 in an assembled or folded condition for transport.

DESCRIPTION OF THE PREFERRED EMBODIMENT

Figure 3:
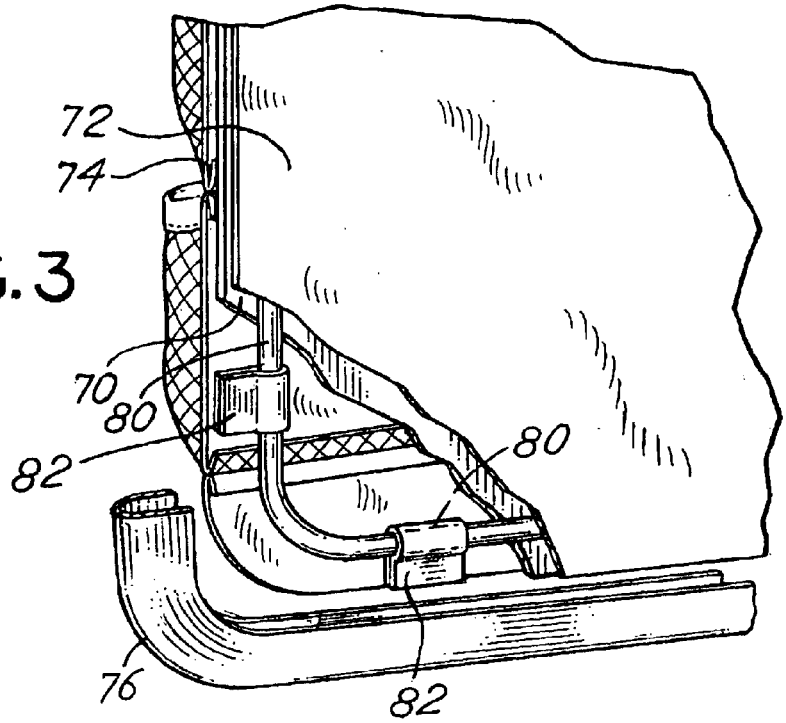
FIG. 3 is an exploded isometric view of a cut-away section of a corner of the organizer of FIG. 1 illustrating the construction thereof as viewed from the back side of the organizer.

A first embodiment of the hanging organizer of the invention is depicted in FIGS. 1, 2, and 3. The organizer is comprised of a generally rectangular planar member 1 having a front side 12 and a back side 14. The front side 12 is formed with pockets, for example, pocket 16 which is accessible through a top opening 17. Pocket 16 may include an adjustable top elastic band 18. Front side 12 may also include a series of individual and separate vertical or slanted access slots 20 of pockets 21; a series of open top, adjacent pockets 22 24, and 26; a supplemental open top, access pocket 28 with a closure flap 29 and writing instrument holders or loops 30. A padded portion or section 34 of the organizer is arranged along bottom edge 32 of panel 10 to receive pins, thumbtacks, and the like. The pad of section 34 is retained in position by a mesh fabric material.

FIG. 2 illustrates the construction of back side 14. The back side 14 includes a series of projecting rivets 40, which extend outwardly and are arranged in a generally linear, vertical row adjacent and transverse to the upper edge 42 of the panel 10. Rivets 40 are designed to cooperate with a clip 44 having a rivet engaging notch 45. The clip 44 is attached to and supported on a wire frame 47 having a support web 46. Frame 47, in turn, is attached to a wire hook assembly 48. The frame 47 and web 46 fit through a fabric loop 50 attached to the back side 14. The notch 45 of buckle or clip 44 may then engage an appropriate rivet 40 for support of the hanging organizer. The remaining rivets 40 are prevented from scratching a door or panel by virtue of web 46 which fits over them.

Figure 4:
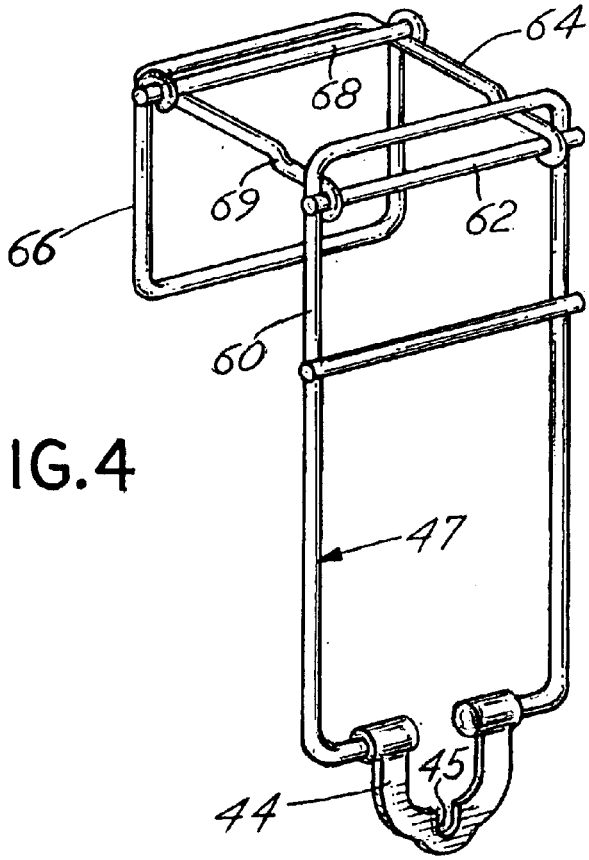
FIG. 4 is an enlarged perspective view of the hook construction associated with the hanging organizer of FIG. 1.

The hanger or hook assembly 48 is depicted in greater detail in FIG. 4. The hanger 48 is made from an assembly of wire rods and includes a first U-shaped frame member 60 having a cross member 62 with a second U-shaped member 64 attached to the cross member 62 and pivotal about the cross member 62 between an angled position as illustrated in FIG. 4 and a straight upwardly extending position or straight downwardly extending position folded against the panel 10.

A third U-shaped member 66 is attached to a pivot rod 68 associated with the second U-shaped pivot member 64. The third member 66 likewise pivots about the cross member 68 so that the second member 64 and third member 66 may be folded flat against the panel 10 or folded upwardly from the panel 10. Bend 69 in wire 64 allows such flat folding. This facilitates storage and transport of the organizer.

In operation the hook or hanging member or hanger 48 of FIG. 4 is positioned over the top edge of a door or work cubicle panel to thereby hold the organizer flat against the wall or door as the case may be.

FIG. 3 illustrates in greater detail the construction of the panel 10. Panel 10 includes an internal polyethylene board 70 which is semi-rigid and may include horizontal break lines to permit folding about various horizontal axes for folding and shipment of the organizer. A fabric material, canvas material, or layer or cover 72 encapsulates the back side 14 of the organizer. Similarly a fabric front panel or layer or cover 74 encapsulates the opposite or front side of the polyethylene board 70. To facilitate the connection of the fabric front panel layer 74 and the back panel layer 72, a binding 76 is stitched to the fabric panel layers 72 and 74. Preferably a circumferential or partially circumferential reinforcing wire or rod 80 is retained between the fabric layers 72 and 74 by means of fabric slings 82 which engage or wrap around the wire 80 and are sewn in position between layers 72, 74 when the binding 76 is attached to layers 72, 74. The wire 80 may extend totally around the circumference of the panel 10 or may extend only partially around the circumference of the panel 10 to provide reinforcement of the hanging organizer or the separate panels comprising the panel 10.

FIGS. 5 and 6 illustrate alternative embodiments of the hanging organizer. In FIG. 5 a panel 90 supports a single pocket having a front section panel 92 and flexible side section panels 94, 96. Such an arrangement may be utilized for holding larger items, plants, etc.

Referring to FIG. 6, a back panel 100 having a hook attachment mechanism 102 is designed to support three pockets which are accessible from the top side. Thus a first pocket 104 is accessible along its horizontal top edge. Similarly a second pocket 106 is accessible, but is vertically lower than the first pocket 104. A third pocket 108 is arranged beneath the second pocket 106. The three pockets 104, 106, and 108 can be sized to hold, for example, legal or letter sized folders or papers. Positioned along the bottom portion of the panel 100 is a mesh 110 which holds a material or pad that will, for example, receive stick pins, thumb tacks, and the like.

FIGS. 7, 8 and 9 illustrate an alternative embodiment of the invention and depict the manner in which the organizer may be supported on a horizontal platform such as the edge of a table or desk. Thus, referring to FIG. 7, the organizer 140 is assembled or condfigured in a manner similar to the previously described embodiments. A lower panel 142 is hinged to an upper panel 144 via a flexible hinge section 146. The construction of the panels is as previously described.

Lower panel 142 includes a pocket 148 with a flap 150 attached thereto by fasteners 152 and 154. The lower edge of the panel 142 includes a hand carry strap 156.

The upper panel 144 includes a pocket 158 having a mesh panel 160 an a series of loops 162 for carrying tools, writing instruments or the like. Upper edge 164 of upper panel 144 includes a carrier or hanging bar construction 166. The hanging bar construction includes opposed, parallel L-shaped legs 168 and 170, formed from a continuous bar which includes a horizontal run 172 that fits through a fabric loop 174 along upper edge 164. The ends of L-shaped legs 168, 170 connect with a horizontal run 175. Secondary projecting support legs 176 and 178 extend from the opposite end of the L-shaped legs 168, 170. The support legs 176, 178 include rubber or elastomeric pads 180, 182. The horizontal crossbar 174 includes cushioned sections or rubber pads 184, 186.

As illustrated in FIG. 8, the hanging bar construction 166 may be positioned over the horizontal panel or edge 188 of a desk or table and thus be mounted on a desk 190, for example. FIG. 8 further illustrates an alternative construction for upper panel 144. Thus, the pocket 158 includes dividers, such as divider 192 and divider 194. Both embodiments of FIGS. 7 and 8 may be fitted over a horizontal panel 188 or alternatively may be fitted over the top of a door or vertical panel by pivoting the carrier 166 by 90° from the position depicted in FIG. 8 in the direction of the arrow shown in FIG. 8 so as to be positioned to fit over a vertical panel. Thus, the embodiment of FIGS. 7 and 8 is especially useful in an office environment as well as a repair shop or work shop environment.

Referring next to FIG. 9, the embodiments of FIGS. 7 or 8 are depicted in a folded condition. The lower panel 142 thus is folded about the flexible section 146 in opposed relation to the upper panel 144. Upper panel 144 includes a hand carry strap 145. The straps 156 and 145 thus may be utilized to carry the assembled and folded article. Prior to folding the panels 142, 144 in opposed relation, the attachment or support member or carrier 166 is pivoted in the loop 174 so that it is positioned intermediate the panels 142 and 144. An attachment strap 147 may then be fastened via a buckle 149 to hold the panels 142 and 144 together. In this manner, the assembly may be carried in a compact manner for storage, for carriage, for packaging and for display at a retail center.

Various embodiments and arrangements of the pockets may be provided on the front of the panels of the organizer. The organizer can be used in many environments, for example, in an office environment, in a kitchen environment, in a work room environment, and the like. Thus, the invention is to be limited only by the following claims and equivalents thereof.

What is claimed is:

1. A hanging organizer and storage device comprising, in combination:

a generally parallelepiped panel including a front side, a back side and a top edge wherein the top edge includes an adjustable hanger and hook mechanism attached thereto for support of the panel on a door or cubicle wall, said panel including:

(a) a semi-rigid internal board with a front side and a back side;

(b) an elongate reinforcing wire extending at least partially circumferentially around the internal board;

(c) a first fabric cover on the front side of the board covering the board;

(d) a second fabric cover on the back side of the board covering the board, said covers overlying the board with edges exposed about the circumference of the board;

(e) multiple slings which fit over the reinforcing wire;

(f) a circumferential binding around the board attached to the slings and the first and second fabric covers; and (g) said adjustable hanger and hook mechanism including a wire frame assembly including a first frame for attachment at the top edge of the panel; and an articulated second wire frame attached by a hinge connection to the first frame to comprise a foldable hook.

2. The organizer of claim 1 further including at least one pocket affixed to the front side.

3. The organizer of claim 1 or claim 2 further including a cushion member for pins on the front side.

4. The organizer of claim 1 wherein the hanger and hook mechanism comprises a strap member depending from said wire frame assembly with at least one receptacle, and further including at least one rivet attached to the panel for cooperative engagement with said receptacle.

5. The organizer of claim 1 wherein the hanger an hook mechanism comprises a fabric loop on the panel and said frame assembly includes a pair of opposed, spaced legs for fitting over a panel, said legs being pivotally attached to the panel loop.

6. The organizer of claim 1 further where said panel comprises first and second articulated sections foldable together with storage pockets in opposed relation when folded.

7. The organizer of claim 6 further including a carry strap attached to each section.

8. The organizer of claim 6 further including a fastening strap for attaching the sections in a folded condition.

9. The organizer of claim 6 where the wire frame assembly is foldable between the sections when said sections are folded in opposed relation.

10. A hanging organizer and storage device comprising, in combination:

a generally parallelepiped panel including a front side, a back side and top edge wherein the top edge includes an adjustable hanger and hook mechanism attached thereto for support of the panel on a door or cubicle wall, said panel including:

(a) a semi-rigid internal board with a front side and a back side;

(b) an elongate reinforcing wire extending at least partially circumferentially around the internal board;

(c) a first fabric cover on the front side of the board covering the board;

(d) a second fabric cover on the back side of the board covering the board, said covers overlying the board with edges exposed about the circumference of the board;

(e) multiple slings which fit over the reinforcing wire;

(f) a circumferential binding around the board attached to the slings and the first and second fabric covers; and (g) said adjustable hanger and hook mechanism including a fabric loop along the top edge, a frame assembly comprised of a first horizontal run extending through the loop, first and second L-shaped legs attached respectively to the opposite ends of the first horizontal run, and first and second support legs extending respectively from the opposite ends of the first horizontal run, said L-shaped legs and support legs spaced and extending in substantially the same direction to fit over a door, desk or wall panel, said first horizontal run rotatable in the loop.

* * * * *